US006664734B1

(12) United States Patent
Jasper, Jr.

(10) Patent No.: US 6,664,734 B1
(45) Date of Patent: Dec. 16, 2003

(54) TRAVELING-WAVE TUBE WITH A SLOW-WAVE CIRCUIT ON A PHOTONIC BAND GAP CRYSTAL STRUCTURES

(75) Inventor: Louis J. Jasper, Jr., Fulton, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/466,998

(22) Filed: Dec. 17, 1999

(51) Int. Cl.[7] ..... H01J 23/24; H01J 25/34
(52) U.S. Cl. ..... 315/3.5; 315/39.3
(58) Field of Search ..... 315/3.5, 39.3

(56) References Cited

U.S. PATENT DOCUMENTS 3,549,852 A * 12/1970 Scott ..... 315/39.3 X
3,781,702 A * 12/1973 Jasper, Jr. ..... 315/3.5 X
4,107,573 A * 8/1978 Potter et al. ..... 315/3.5

* cited by examiner

*Primary Examiner*—Benny T. Lee
(74) *Attorney, Agent, or Firm*—Paul S. Clohan, Jr.; Edward L.. Stolarun

(57) ABSTRACT

A printed circuit Traveling-Wave Tube (TWT) with a vacuum housing containing either a pair of identical meanderline slow-wave interaction circuits or a pair of multi-arm spiral slow-wave interaction circuits printed on two identical Photonic Band Gap crystal structures, and a gridded electron gun assembly. Printed on the two identical Photonic Band Gap crystal structures are electrical connections to connect the heater, cathode, grid and acceleration electrodes of the electron gun assembly to a power supply, RF input and output connectors surrounded by ground planes, a depressed collector, and a set of electrical connections to the depressed collector. Zig-zag metal spacers between the two identical Photonic Band Gap crystal structures are used to form the electron beam vacuum gap. Printed conducting metal strips on each side of the meanderline slow-wave interaction circuits are used for electrostatic focusing and to reduce beam edge effects of a sheet electron beam.

20 Claims, 14 Drawing Sheets

| BEAM THICKNESS | PBG CRYSTAL STRUCTURE SPACING |
|---|---|
| 0.06" | 0.10" |
| 0.08" | 0.13" |

$$Z = \frac{j\omega L}{1-\omega^2 LC}$$

- UWB STOP-BAND: 0.73-1.3 GHz
- TRANS/REC BANDS
  1.17 GHz $\varepsilon_1$ → 26
  0.85 GHz $\varepsilon_2$ → 26
  0.95 GHz $\varepsilon_3$ → 26
- $\varepsilon_r$ = 22 (ALL SUB-CRYSTALS)

TRAVELING-WAVE TUBE WITH A SLOW-WAVE CIRCUIT ON A PHOTONIC BAND GAP CRYSTAL STRUCTURES

RIGHTS OF THE GOVERNMENT

The invention described herein may be manufactured, used, and licensed by or for the United States Government for governmental purposes without the payment to us of any royalty thereon.

BACKGROUND OF THE INVENTION

In the 1969 to 1975 time frame, the US Army had two Research and Development (R&D) efforts aimed at developing printed circuit Traveling Wave Tubes (TWTs). One effort utilized a meanderline as the slow-wave printed circuit on a dielectric substrate and a sheet electron beam to obtain amplification. The second effort utilized an equiangular spiral slow-wave printed circuit on a dielectric substrate and a radial traveling electron beam to obtain amplification. The primary goal of both R&D efforts was to demonstrate the feasibility of a TWT that was lower cost than a conventional TWT, and bridged the gap between solid state technology and vacuum technology for microwave oscillator/amplifier devices. The low cost of the TWT was achieved by printing on a pair of Ceramic substrates all of the internal tube parts except the cathode-grid assembly and spacers required to have a vacuum gap for beam flow. That is, the beam forming electrodes, collector, and microwave and electric connections are printed on a pair of ceramic substrates, which have two identical printed microwave slow-wave circuits. Amplification of a microwave signal propagating on the slow-wave circuits occurs by the well-known beam-wave, circuit-wave interaction. The amplification mechanism requires velocity synchronism between the space-charge wave on the beam and the electromagnetic (EM) wave on the circuit, where dc energy is extracted from the beam and converted to microwave energy. The electron beam is generated by a thermionic cathode (heated cathode) or field-emitter cathode (cold cathode), focused by beam forming electrodes (grid/anode) and magnet structure, and collected by the printed collector. For the equiangular spiral TWT, the sheet beam is a radial directed beam that travels outward from the cathode located on an innermost circumference to the collector located on an outermost circumference. The linear beam TWTs were designed and built to operate in S-band and the radial beam TWT was designed and built to operate in L hand from 0.5–1.5 GHZ. A C-band, linear beam TWT was designed and it is described in "A Design Study of C-band Printed Circuit TWT" an Army report dated May 1971.

Some technical problems were not solved in the 1970's, which adversely affected tube performance and thus were obstacles in achieving prototype production tubes. The ceramic substrates have a large dielectric loading effect, which lowered the interaction impedance, gain, and efficiency. Partial solutions to these problems compromised high-duty cycle operation. In order to achieve a higher gain and efficiency, air or low dielectric material gaps were placed between the ceramic substrates and metal tube housing. The gaps reduced the energy stored between the ceramic substrates and metal tube housing. This improved the beam interaction, gain, and efficiency at the expense of duty cycle, since the air gaps made it more difficult to transfer heat generated inside the tube to the outside environment. Also, the air gaps caused a more rapid gain roll-off over the frequency bandwidth of operation.

This invention replaces the ceramic substrates and metal ground planes with Photonic Band Gap (PBG) crystal structures. In particular the two- or three-dimensional Metallodielectric Photonic Crystals (MPCs) are used as the supporting structures for the printed slow-wave interaction circuits. This will significantly increase the interaction impedance, gain, and efficiency without compromising gain roll-off and duty cycle. The air or low dielectric material gaps are not needed between the PBG structures and tube housing to significantly improve the interaction impedance.

The two-dimensional MPCs (high-impedance surfaces) have surface band gaps that reduce EM propagation (typically −10 to −20 dB) through the crystal. They also forbid surface currents, unlike metals. The three-dimensional MPCs can be made to have both bulk and surface band gaps, and these two band gaps can be engineered to overlap. The bulk band gap forbids EM propagation (typically −40 to −60 dB) through the crystal. They also forbid surface currents, unlike metals. In addition, the MPCs are excellent heat sinks because they contain metal elements. In particular, the metal elements of the two-dimensional MPCs are attached to the ground plane. The excellent heat sink property allows high duty operation of the TWTs.

SUMMARY OF THE INVENTION

Accordingly, it is an object of the present invention to provide a TWT that is compact with a low-cost design.

It is another purpose of this invention to improve tube performance over prior art printed circuit TWTs.

It is also another purpose to reduce or eliminate oscillations in the TWT.

Another objective of this invention is to eliminate the air or low-dielectric material gaps between the substrates and tube housing that were used in prior art.

A further objective of this invention is to increase the critical frequency of printed circuit TWTs.

Another objective of this invention is to have multiple devices in one package.

The foregoing and other objects are achieved by an invention in which all of the tube's internal parts are printed on metallodielectric photonic crystal (MPC) structures except for the cathode-grid assembly and spacers required to maintain a vacuum gap for the electron beam propagation region.

This invention has higher duty cycle capability, higher interaction impedance, larger bandwidth, and higher critical frequency over prior art, which in turn gives higher gain, higher rated power and higher efficiency of the TWT.

These objectives are realized by using PBG crystals with one or more defects as the structures for the printed slow-wave interaction circuits. It is well known by tube designers that the radio frequency (RF)/microwave signal when coupled onto a slow-wave circuit decays approximately exponentially away from the circuit. If the circuit is on a dielectric substrate, dielectric loading further decreases the EM fields in the vicinity of the electron beam. It is highly desirable to have large EM fields in the direct vicinity of the electron beam to significantly increase the interaction impedance, gain, and efficiency. The PBG crystal accomplishes this because it is designed to have a forbidden band gap over the bandwidth that the TWT is designed to operate. An incoming EM signal whose carrier frequency is well within the forbidden band gap, and whose line width is finite, cannot penetrate (usually at least −20 dB) the crystal, and is reflected away from the crystal. For a PBG crystal composed of low-loss media, (loss-tangent <<1), large electric field oscillations, are built up in the direct vicinity of the beam, which causes the beam to bunch. Coupling of the beam with the EM circuit wave occurs when the beam velocity slightly exceeds the phase velocity of the circuit mode. Forward and backward operation of the TWT is possible. When the phase and group velocities are in the same direction, forward operation occurs. When the phase and group velocity are in the opposite direction, backward operation occurs. Operation in the forward mode gives higher power (amplification) and larger instantaneous bandwidth; operation in the backward mode gives voltage tunability.

The interaction impedance is furthered enhanced because the beam is sandwiched between two PBG crystal structures. The EM fields that decay away from the circuit on one PBG crystal structure in the direction of the other PBG crystal structure are also forbidden from entering that substrate which causes high EM fields to build up in direct vicinity of the electron beam.

Suppression of internal oscillations can be a serious problem, especially, for high-gain tubes. Techniques are needed to prevent high EM fields from existing in unwanted modes. PBG crystals that have induced defects can reduce or eliminate oscillations. The perfect two or three-dimensional translational symmetry of a PBG crystal can be lifted in either one of two ways: (1) extra dielectric (permittivity), or permeability, or metal materials can be added to one or more of the unit cells. This type defect behaves much like a donor atom in a semiconductor that gives rise to donor modes with origins at the bottom of the conduction band. (2) Conversely, by removing some dielectric/permeability material from one or more of the unit cells, defects occur which resemble acceptor atoms in semiconductors. The PBG crystal can be designed to have donor and acceptor defects, which allow EM transmission (pass bands) through the PBG crystal at frequencies which are functions of the defects. Therefore, to prevent oscillation buildup at a given frequency, one can create a defect(s) in the PBG crystal at the oscillation frequency thus reducing the EM fields in the vicinity of the beam. The acceptor/donor level frequency within the forbidden band gap is a function of the defect volume removed or added. The technique of creating defects in PBG crystals to prevent oscillations is a significant improvement over conventional techniques such as cutting slits in the circuit or adding distributed loss on the circuit by painting a lossy material such as aquadag. These techniques can increase the insertion loss by greater than 10 dB which means the circuit length has to be extended to obtain reasonable gain.

Another objective of this invention is to eliminate the air or low-dielectric material gaps between the substrates and tube housing that were used in prior art. The gaps were found to be necessary to raise the interaction impedance in the prior art printed circuit TWTs. However, the gaps lower the duty cycle because it is difficult to transfer heat buildup inside the tube to the outside environment. In addition, the gain response of the tube with the gaps was shown in prior art to falloff more rapidly, which narrows the bandwidth. In the prior art, the region between the outer (back) surfaces of the ceramic substrates and tube housing stored energy due to fringing fields. By removing the ground plane away from the back surfaces of the ceramic substrates and creating an air or low dielectric material gap, the interaction impedance increases and the useful bandwidth decreases because the circuit becomes more dispersive. In this invention, the MPC structures do not allow surface currents. Thus FM energy with frequency content in the forbidden band gap can not leak behind the structures, and can not effectively penetrate the PBG structures due to the band gap. Since the air or low-dielectric gap is not required for this invention, the interaction impedance, bandwidth, and duty cycle are improved over prior art printed circuit TWTs. The duty cycle is further enhanced by this invention since heat generated on the slow-wave circuits can be conducted to the outside environment via the metal elements in the MPCs and ground planes. The two-dimensional MPC is an excellent heat sink, since it is a thin structure with the metal elements inside the MPC attached directly to a ground plane, which in-turn is in direct contact with the metal vacuum housing.

A further objective of this invention is to increase the critical frequency of printed circuit TWTs. This frequency is where rapid fall-off of gain occurs. It was found that the critical frequency, $f_c$ for the equiangular spiral amplifier is proportional to $1/\sqrt{(\in_r+1)}$. That is $f_c \propto 1/\sqrt{(\in_r+1)}$. As an example, for a dielectric substrate with a dielectric constant of 8, $f_c$ is reduced by a factor of 3. For a two- or three-dimensional, 50-ohm impedance MPC structure, the EM fields penetrating the structure are drastically reduced, and are reflected at its surface when the frequency content lies within the PBG. Therefore, the effective dielectric constant that the microwave signal sees approaches a value of 1. The sheet insulator that supports the slow-wave circuit (see FIG. 5) can have a low dielectric constant of less than 4, and since this insulator sheet is very thin ($<<<\lambda_0$), its effective dielectric constant is negligible. Therefore, $f_c$ is only reduced by a factor of about $\sqrt{3}$. Thus the critical frequency of the TWT would be about 1.7 times higher for the 50-ohm PBG crystal structure as compared to the dielectric substrate used in prior art. This means that the TWT can be designed to have a bandwidth that is as much as 50% higher than the prior art printed circuit TWTs.

Other examples of how the dielectric constant of the ceramic substrate adversely affects tube performance for the planar equiangular spiral amplifier are:

Interaction impedance, $K \propto 1/(\in_r+1)$, gain, $G \propto 1/(\in_r+1)^{1/3}$, phase velocity, $v_p \propto 1/(\in_r+1)$, and maximum power output at any frequency, $P_o \propto 1/(\in_r+1)^{321}$. Lowering the effective dielectric constant, $\in_r$ of the substrates that support the slow-wave circuits is highly beneficial to achieve higher efficiency.

Another objective of this invention is to have multiple devices in one package. For example, the oscillator driver that is needed to excite a TWT amplifier, can be printed on the same PBG structure. Since surface currents are eliminated with the MPC structures, multiple devices are electrically isolated at high radio frequencies (RF) with no cross talk or microwave coupling.

In one embodiment, the printed circuit TWT is composed of two identical PBG crystal structures with two identical meanderline slow-wave circuits printed on them, arranged in a parallel fashion with a vacuum gap (for beam flow) between them, and placed in a housing which forms a vacuum envelope. All of the internal elements are printed on the inner surfaces of the PBG crystal structures except the gridded electron gun and spacers, which are the only non-printed elements inside the tube. The magnet focusing structure is placed on the outer surface of the tube housing. The electrical and RF input and output connections are brought into the tube via standard connectors and are connected internally by printed coupling lines when required such as for the one or two stage printed depressed collector. Some design features of this embodiment are given below.

Design features may vary from tubes built for specific applications and those design changes are well known to people skilled in the art.

1. Multiple strapped meanderline slow-wave circuits
2. Period tapering of the meanderline to improve synchronism between beam and wave
3. Non-intercepting or intercepting gridded gun.
4. Thermionic or field emitter cathode
5. Single-stage or multi-stage depressed collector.
6. Air or liquid cooling means.
7. Temperature compensated PPM focusing magnets.
8. Electrical focusing elements for the sheet electron beam.
9. Two-dimensional and three dimensional 50-ohm impedance MPC structures with narrow, wide, or ultra wide forbidden band gaps.
10. PBG crystal defects to reduce or eliminate oscillations, or to change the circuit dispersion characteristics
11. Low-loss tangent and high-voltage breakdown dielectric material for the PBG crystal structures.
12. Ferroelectric PBG material for changing the dispersion characteristics of the MPC and the slow-wave interaction circuit in real time.
13. Two-dimensional and three-dimensional 50-Ω MPC structures to forbid surface currents.
14. Backward or forward wave interaction RF circuits (amplifier or oscillator designs)
15. Space-charge wave or transverse wave beam interactions.

In another embodiment, the printed circuit TWT is composed of two identical PBG crystal structures with two identical equiangular, slow-wave circuits printed on them, arranged in a parallel fashion with a vacuum gap between them, and placed in a housing to form a vacuum envelope. All the elements necessary for generation of microwave power are printed on the inner surfaces of the PBG crystal structures except for the gridded electron gun assembly and spacers. The magnet focusing structure is placed on the outer surface of the housing. The electrical and RF input and output connections are brought into the tube via standard connectors and are connected internally by printed coupling lines when required such as to the printed collector. The printed design techniques of this embodiment are similar to those given above for the first embodiment. Also design features for this embodiment may vary for the tubes built for specific applications, and these design features and changes are well known to people skilled in the art. For example, the two-arm spiral slow-wave circuits (one on each PBG crystal structure) may be wound in the same or opposite sense (clockwise or counter-clockwise).

When one spiral is wound counter-clockwise and the other spiral clockwise, the interaction impedance increases but at compromise of bandwidth. Unlike the meanderline circuit, which has a 10–15 bandwidth, the equiangular spiral circuit exhibits ultra-wide band (multi-octave). The equiangular spiral could be replaced by an Archimedean spiral, which would decrease the bandwidth, but increase the interaction impedance. For this embodiment, a two-arm spiral circuit is used. For higher voltage operation, a four-arm spiral could be utilized with the complication of coupling and uncoupling the RF energy. Higher voltage operation results when more arms are added to the spiral circuit because the spiral arms are not as tightly wound. For this embodiment which, requires multiple input and output connectors, an optoelectronics technique can be used that uses light activated semiconductor switches in conjunction with a mode-locked laser to generate picosecond risetime current pulses. The laser beam, which is jitter-free can be used to switch impulse currents onto the spiral arms which will produce an ultra-wide band microwave signal, for amplification. This technique eliminates the RF input connectors.

BRIEF DESCRIPTION OF THE DRAWINGS

The invention will be better understood, and further objects, features, and advantages thereof will become more apparent from the following description of the preferred embodiment, taken in conjunction with the accompanying drawings in which.

DETAILED DESCRIPTION OF THE PREFERRED EMBODIMENTS

Figure 1:
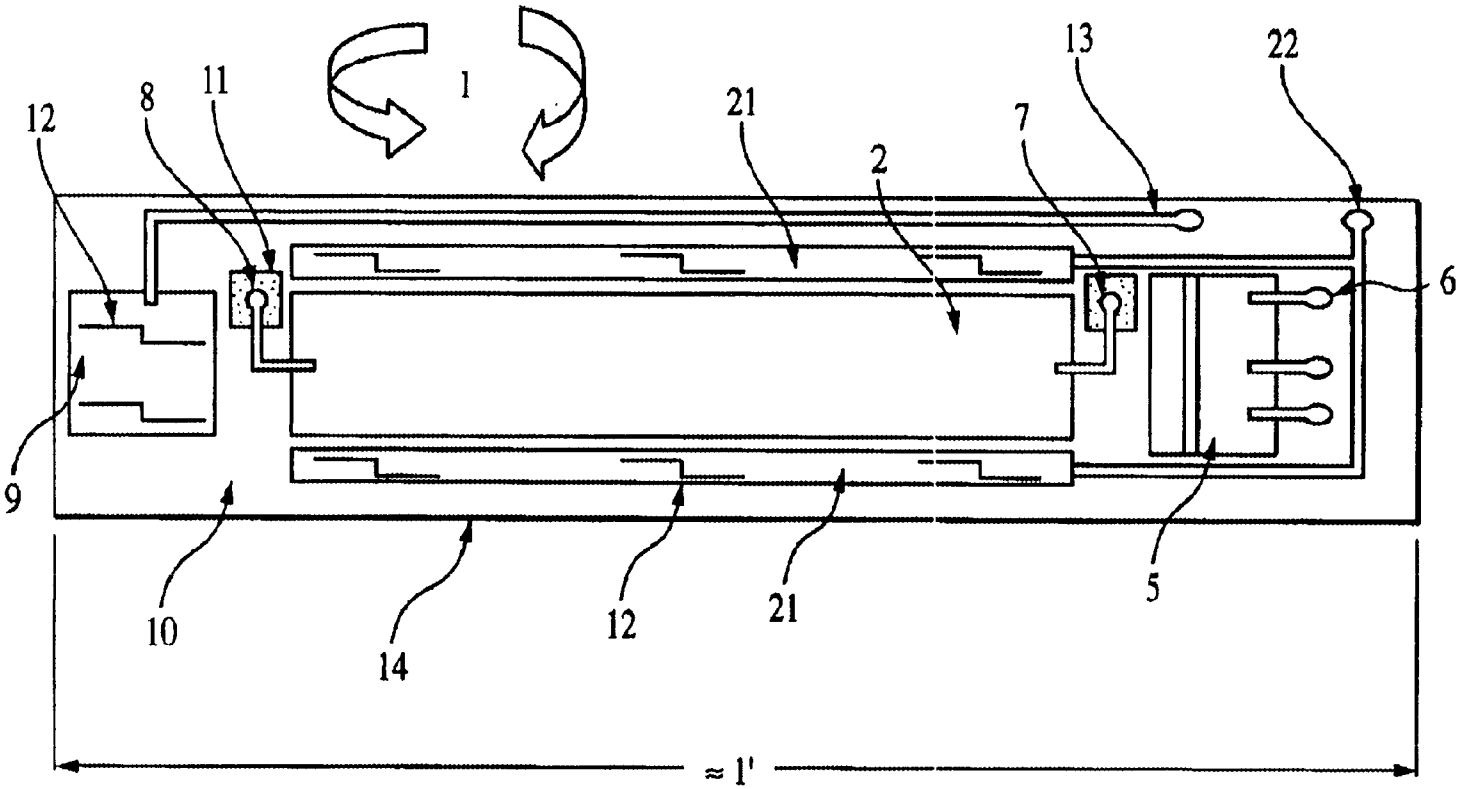
FIG. 1 is a block diagram of one half of the inside of the printed circuit TWT that uses a meanderline slow-wave interaction circuit and operates in S-band.
Figure 2:
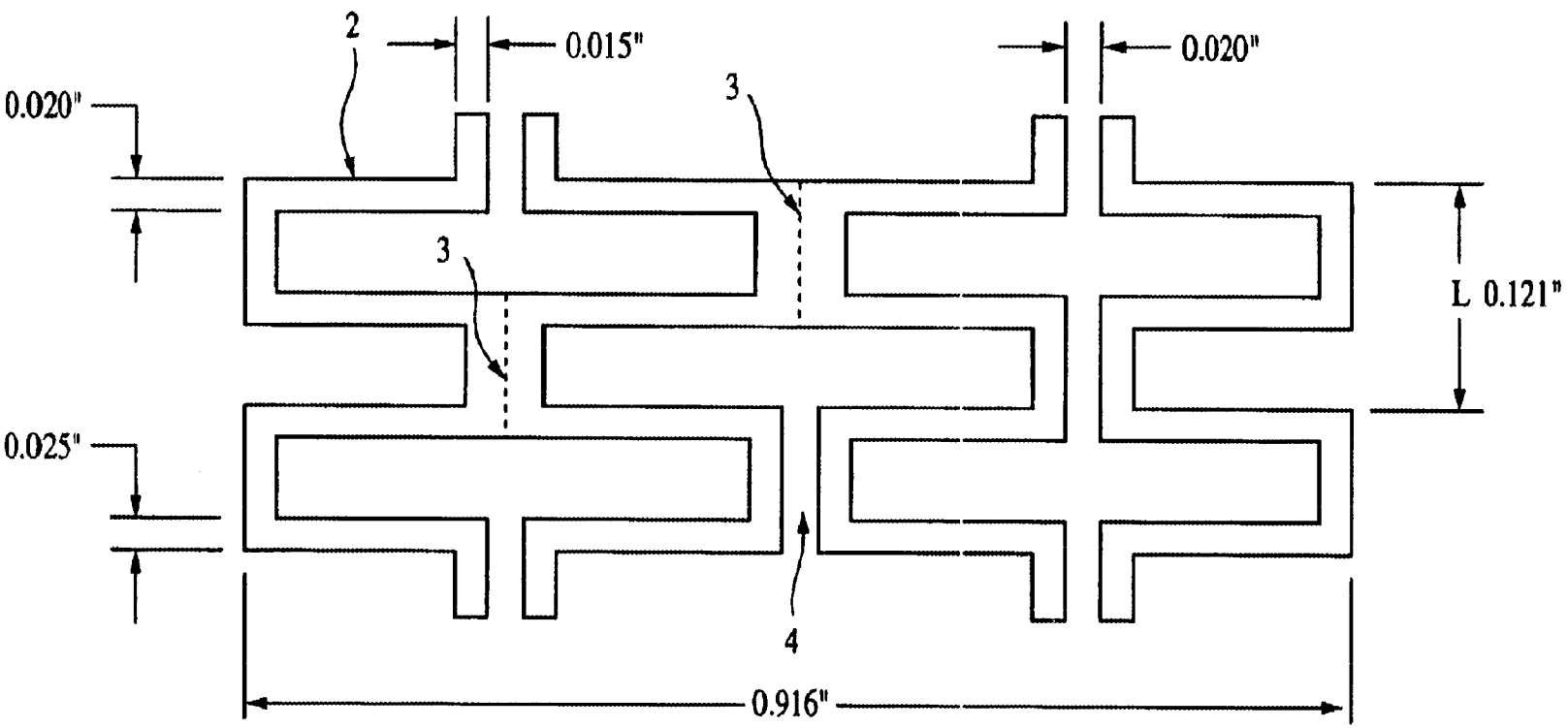
FIG. 2 is a schematic drawing of a portion of a meanderline slow-wave interaction circuit for a tube operating in S-band.

Referring now to the drawings, there is shown in FIG. 1 a block diagram of one half of the inside of a printed circuit S-band TWT 1 that uses a meanderline slow-wave interaction circuit 2. The meanderline slow-wave interaction circuit 2 is shown in FIG. 2 which is a schematic drawing of two sections of a many section meanderline circuit 2. The dimensions of the multiple strapped meanderline circuit 2 are for an S-band design of the TWT. As can be seen from FIG. 2, the meanderline circuit 2 is periodically joined at 3 and also has periodic slits 4 which are used if required to break-up higher-order modes and suppress oscillations on the right hand side of the printed circuit TWT 1 that is shown in FIG. 1 is the gridded electron gun assembly 5 which could have either a thermionic cathode or a field emitter cathode, and a nonintercepting grid or an intercepting grid. Electrical connections 6 are used to connect the heater, cathode, grid, and accelerating electrodes to the appropriate de power supplies not shown in FIG. 1. The RF input connector 7 and RF output connector 8 are used to couple the microwave energy onto and off of the meanderline slow-wave circuit 2. A one-stage depressed collector 9 is shown on the left-hand side of the printed circuit TWT 1. This collector could also have multiple stages to increase the efficiency of the TWT by allowing the un-spent energy in the electron beam to be more effectively re-couped by collecting the electrons (which have a velocity spread) at voltages which approach the cathode voltage. A multi-staged depressed collector would have a different voltage on each stage, which would in turn collect electrons with the corresponding velocity spread. The electrical connections to collector 9 are made by coming directly out of the tube housing 14, which lies behind PBG crystal structure 10, or they can be made by printing conducting line(s) 13 on the PBG crystal structure 10. This will have all of the dc connections on the cathode side of the tube. The PBG crystal structure 10 is a two dimensional or three-dimensional, 50-ohm impedance MPC structure. The MPC crystal structure 10 is only required to be under the meanderline slow-wave circuit 2 and sufficiently wide to avoid end effects. However, it may be simpler and lower cost to place the PBG crystal structure 10 under all internal parts of the tube. The preferred PBG crystal structures 10 are the 50-ohm impedance MPC structures. The two-dimensional MPC is a thin structure with a surface band gap (typically −10 to −15 dB) that reduces EM energy propagating through the crystal. It also forbids surface currents. The three-dimensional MPC is also designed to have an impedance of 50 ohms. This thicker structure has a bulk band gap (typical −40 to −60 dB) that forbids EM energy from propagating through the crystal. It also can be engineered to have a surface band gap that overlaps with the bulk band gap. This surface band gap forbids surface currents. For the meanderline circuit 2, the shaded regions 11 shown in FIG. 1 surrounding the input and output connectors 7 and 8 respectively indicate ground planes that are used to properly couple and de-couple the microwave energy. The cross-sectional area and depth below the surface for the ground planes 11 are determined by standard transmission line equations well known to tube designers. The zigzag metal pieces 12 fastened to metal strips 21 and collector 9 are used to maintain the required spacing between both PBG crystal structures 10 which is occupied by the electron beam (see FIG. 3). The printed conducting metal strips 21 on each side of the meanderline circuit 2 also serve a dual purpose of electrostatic focusing electrodes to reduce beam edge effects of the sheet electron beam. The electrical connection 22 for conducting metal strips 21 is used to supply the desired focusing voltage.

Not shown in FIG. 1, but indicated by 14 is the tube housing, which contains the PBG crystal structure 10 and the second PBG crystal structure 10 not shown in FIG. 1. The tube housing 14 must have excellent vacuum integrity, which requires standard and well known brazing, welding, or soldering techniques to join both halves of tube housing 14. An excellent vacuum is needed for tube bake-out for high-power conditioning. Preferably, the two sections of tube housing 14 are joined together by brazing or heliarc welding to form the vacuum housing. The two MPC structures 10 that comprise the TWT are identical, and the two meanderline slow-wave circuit 2 are also identical. The dimensions and geometry of both meanderline circuits 2, effective dielectric constant E, of insulating sheets 27, (see FIGS. 9 and 10—the insulating sheet 27 is sandwiched between the meanderline circuit 2 and the NPC structure 10) and impedance of the MPC structures 10 must be identical, or tube performance will degrade. Matching these parameters become more critical as the frequency increases. The only difference between both halves of the tube is that the other half not shown in FIG. 1 will not have the gridded electron gun assembly 5 and spacers 12.

FIG. 2 is a schematic of a portion of the meanderline slow-wave interaction circuit 2. It is a typical slow-wave circuit that can be utilized for both forward or backward wave interaction, and its design and dimensions will change with the frequency and voltage parameters. The length of the meanderline circuit 2 is adjusted for gain, and a pitch or taper is utilized to maintain synchronism as the beam slows down due to energy extraction. Meanderline circuit 2 is printed on the top surface 27 of MPC structure 10 by means well known to people skilled in this art.

Figure 3:
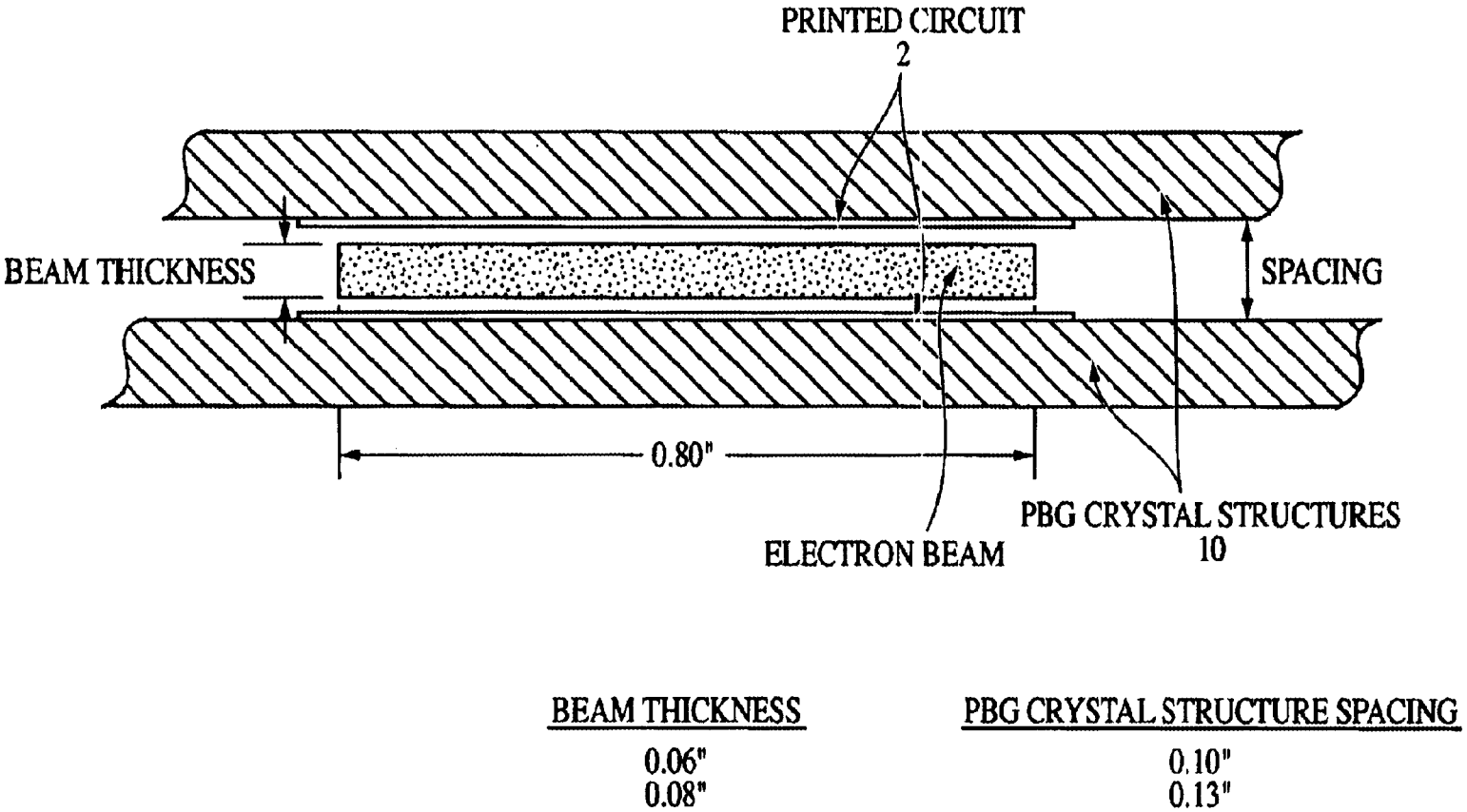
FIG. 3 is a schematic drawing showing the cross-sectional area of the electron beam and its relationship to the meanderline slow-wave circuit and the PBG structures for an S-band TWT.

FIG. 3 is a schematic drawing showing the cross-sectional area dimensions of an electron beam and its relationship to the meanderline slow-wave interaction circuit and PBG crystal structures for an S-band TWT. The thickness of the electron beam and the fill factor (% of space occupied by the beam) must be consistent with the meanderline circuit 2. The electron trajectories are functions of beam thickness, beam microperveance, gridded electron gun design, and magnetic field.

Two RF couplers are needed to couple and de-couple the RF energy from the two meanderline circuits 10. Both of the couplers have semi-rigid coaxial cable lengths on each side, and their lengths must be identical at both the input and output sections of the printed circuit TWT 1 or performance will degrade.

Figure 4:
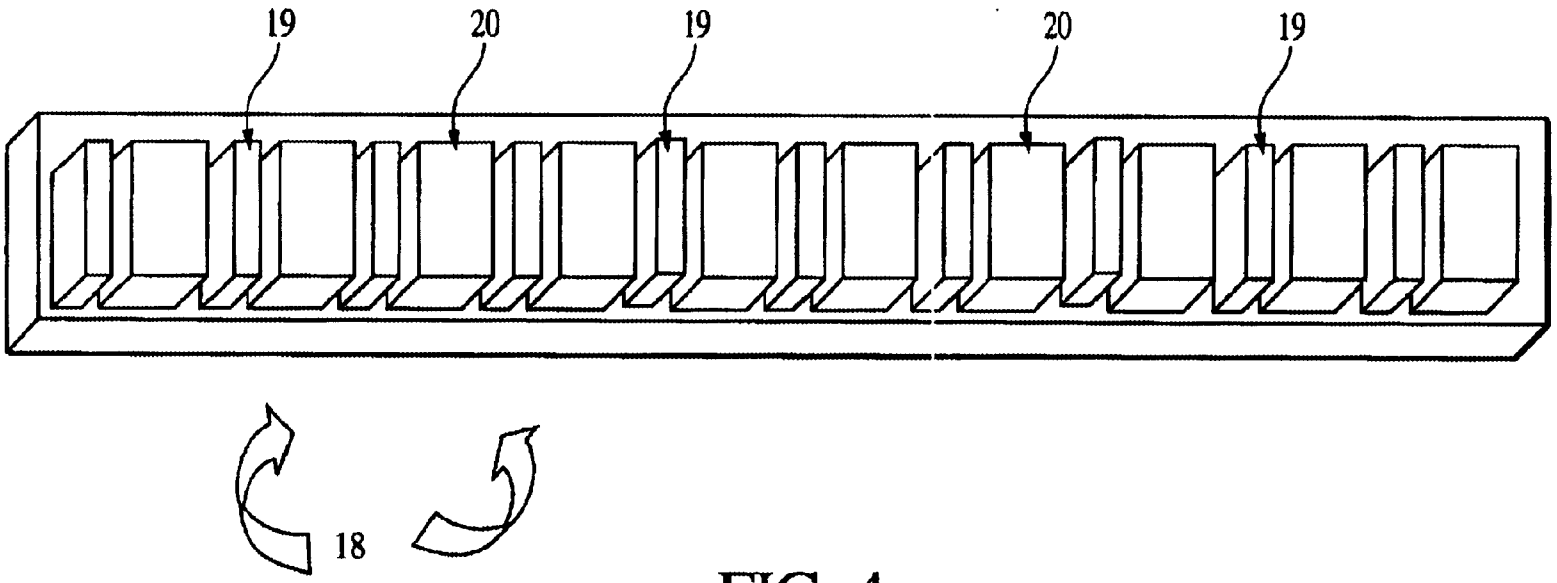
FIG. 4 shows a samarium cobalt magnet array with alternate bars of samarium cobalt magnets and iron pole pieces.

The bar magnet structures 18 can be made from a material such as ceramic, and ac charged to give a PPM field with the desired period magnetized into them. Or the bar magnet structures 18 can be made of samarium cobalt magnets as shown in FIG. 4 with alternate bars of samarium cobalt magnets 20 and iron pole pieces 19. This magnet structure 18 can be temperature compensated by applying the compensator material between the magnet structure 18 and tube housing 14. This is necessary if the magnet such as samarium cobalt is used in which its magnetic field properties are sensitive to temperature changes.

Figure 5:
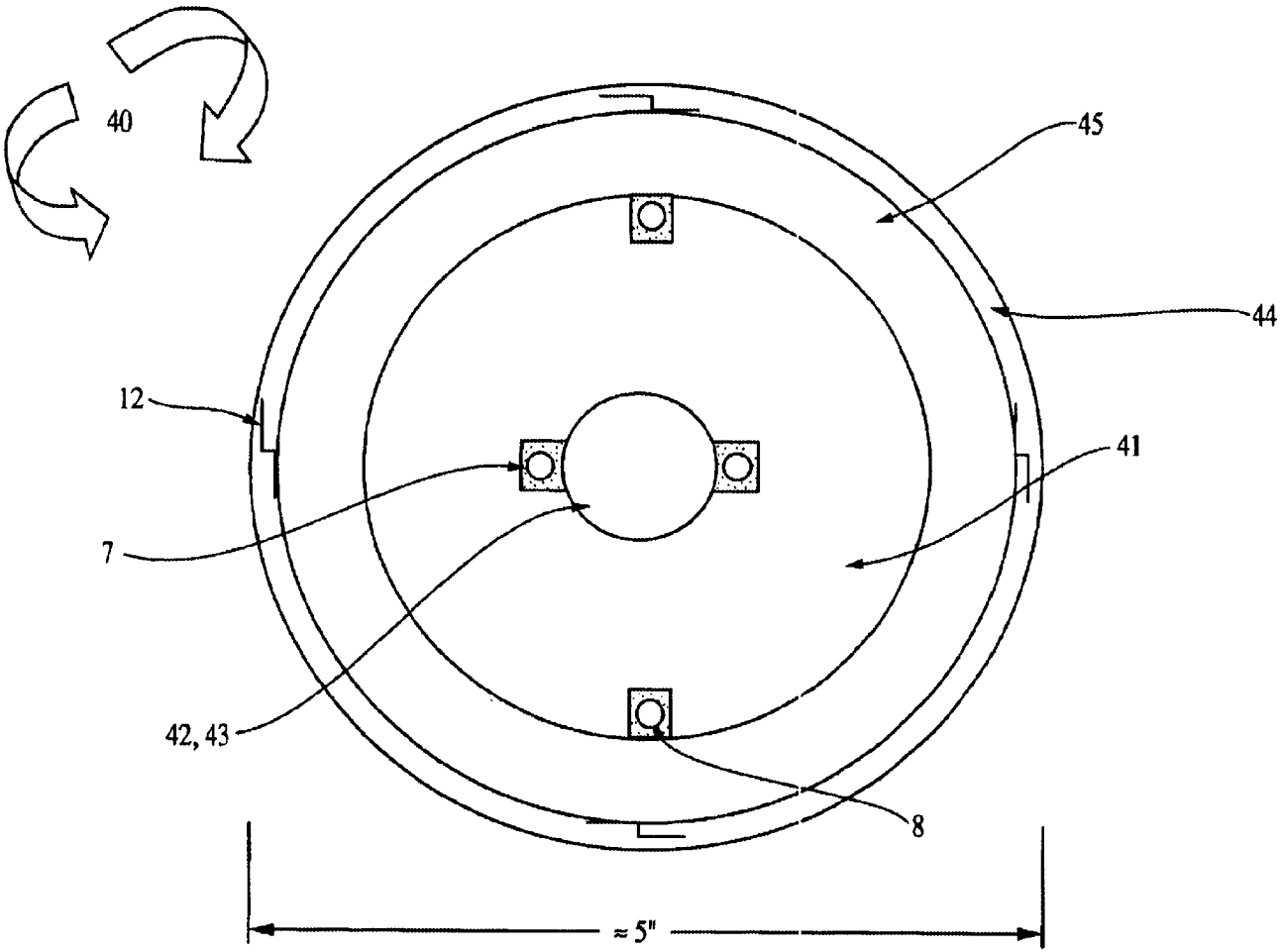
FIG. 5 is a block diagram of one half of the inside of the printed circuit L-band TWT that uses an equiangular slow-wave interaction circuit.

FIG. 5 is a block diagram of one half of the inside of the spiral printed circuit L-band TWT 40 that has a two-arm equiangular spiral slow-wave interaction circuit 41. The cathode assembly 42 and anode assembly 43 are located on the inner most circumferences, and the printed circuit collector 44 is located on the outer most circumference. Spiral interaction circuit 41 is printed on top of the 50-ohm impedance MPC structure 45, which contains a very thin insulator sheet on its top surface. For simplicity and low cost, the MPC structure is used to support all the internal tube parts.

Figure 6:
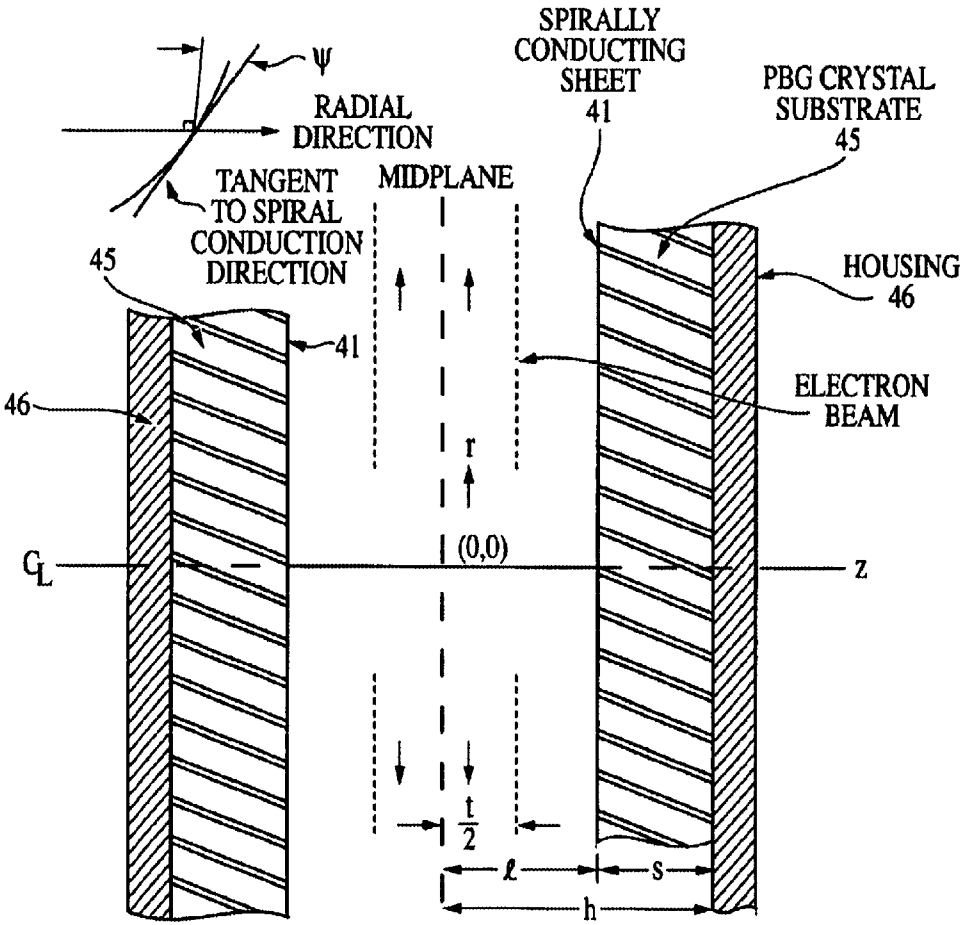
FIG. 6 is a schematic drawing of the electron beam region, PBG crystal structures, and vacuum housing for the equiangular spiral L-band TWT.

FIG. 6 is a schematic drawing showing the electron beam region, PBG crystal structures 45, spiral slow-wave circuits 41, vacuum housing (46), and the region between the two PBG crystal structures 45 not occupied by the electron beam.

Figure 7:
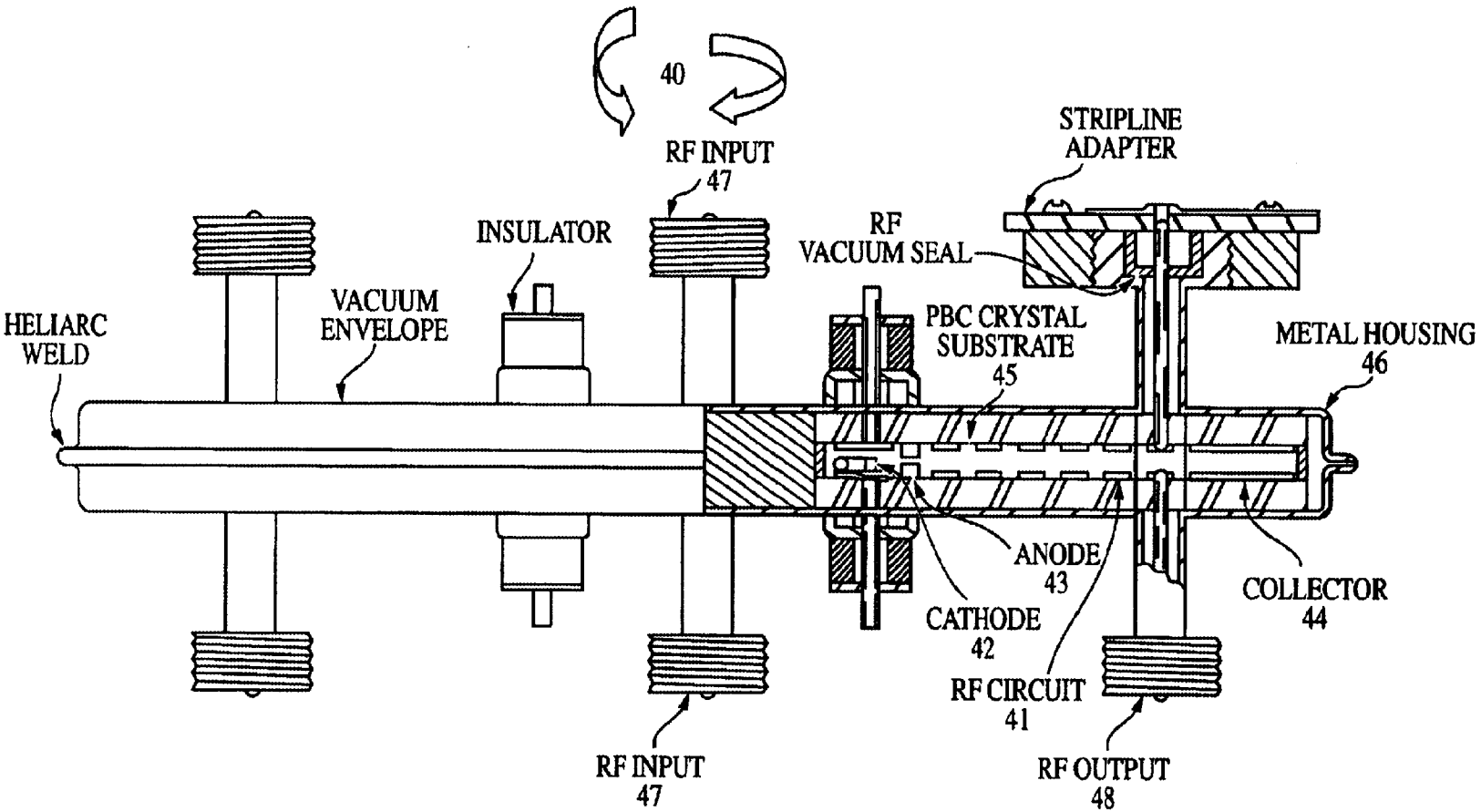
FIG. 7 is a cross-sectional view of the equiangular spiral L-band TWT.

FIG. 7 shows the cross-sectional view of the equiangular spiral printed circuit L-band TWT 40. The PBG crystal structures 45 are placed inside the metal housing 46 and four RF input connectors 47 and four RF output connectors 48 are used to couple microwave energy onto and off of the two spiral slow-wave circuits 41 located on the two identical PBG crystal structures 45.

Figure 8:
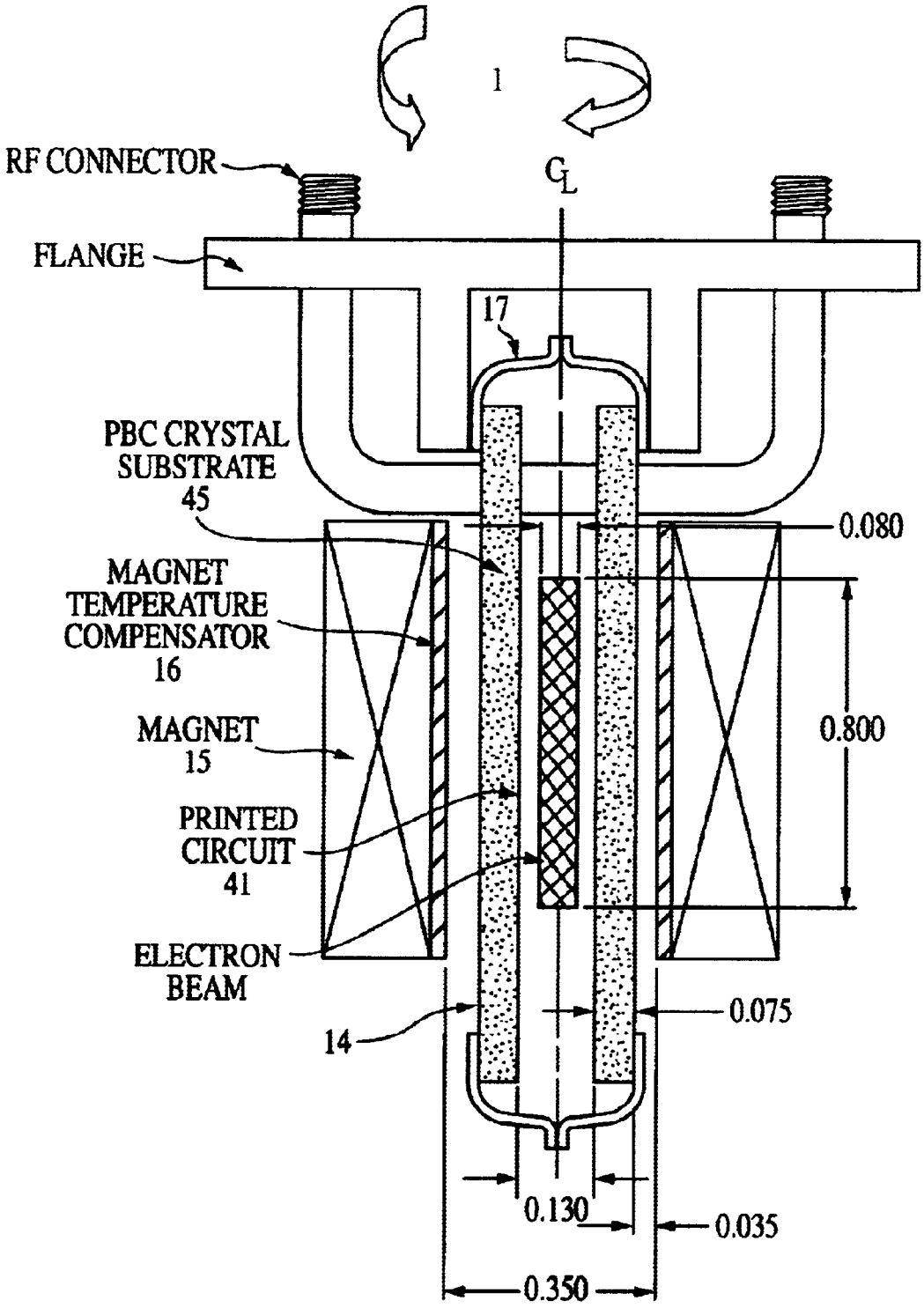
FIG. 8 is a cross-sectional view of the equiangular spiral L-band TWT showing piece part dimensions.

FIG. 8 is also a cross-sectional drawing of the spiral printed circuit TWT 40, which shows typical dimensions for an L-band TWT. The magnet 49 and temperature compensator 50 are shown which are positioned against the vacuum metal housing 46. Flange 51 is used to heliarc weld both vacuum housings together to achieve vacuum integrity. The principle of operation of this embodiment is similar to that of the printed circuit meanderline embodiment. However, for the spiral printed circuit TWT 40, the beam perveance can be quite large and the radial circuit length is small which is the reverse for the meanderline printed circuit TWT 1 where the beam has a microperveance and a long meanderline circuit length. Also, the meanderline tends to have a narrow bandwidth (<30%) where as the spiral slow-wave circuit can have a multi-octave bandwidth. The meanderline printed circuit TWT also tend to operate at larger voltages than the spiral printed circuit TWT. The utilization of the MPC structures for this embodiment offers the same benefits as those for the first embodiment.

Figure 9:
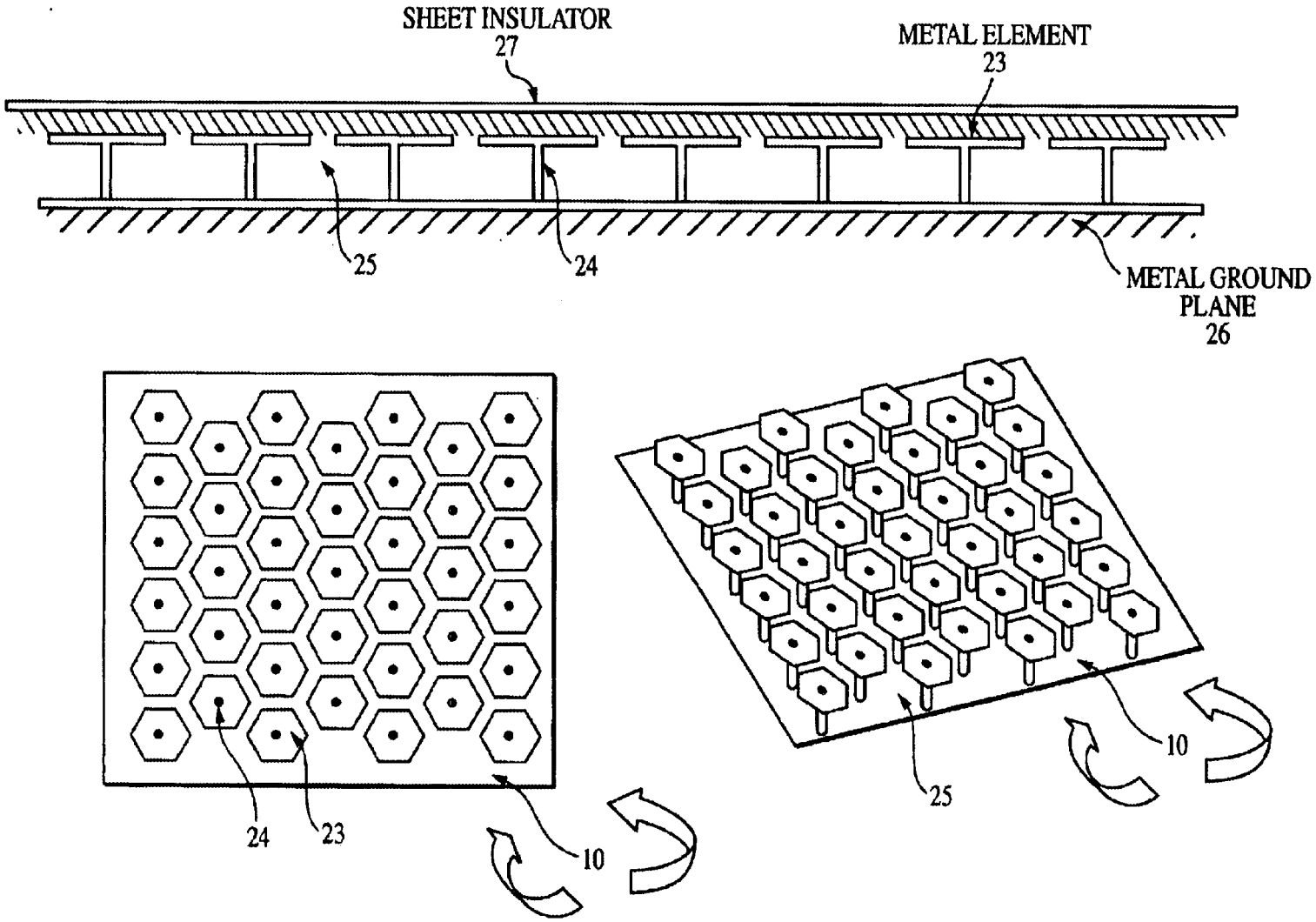
FIG. 9 is a two-dimensional, two-layer MPC high-impedance EM structure.

The MPC structure 10 of the high-impedance EM type is shown in FIG. 9. This high-impedance EM, PBG crystal is a conductive metallic structure, which is designed to have a 50 ohm impedance. It is a two-dimensional, two-layer MPC structure that has a surface band gap, and also suppresses surface currents. It consists of a triangular array of hexagonal shaped metal elements 23. The center posts 24 of metal elements 23 are hole in the host ceramic material 25, and coated on the inner wall with a good conducting material such as copper. The metal center posts 24 touch metal ground plane 26. A very thin sheet ($<<<\lambda_0$) insulator 27 is placed on top of the MPC structure 10, which has both low loss tangent and high-voltage breakdown properties. Voltage arcing at the hexagonal shaped metal edges can be reduced by rounding the edges and by using a high-voltage breakdown dielectric material for the MPC host material 25. Not shown in FIG. 9 is the meanderline circuit 2 that is printed on the thin insulating sheet 27.

Figure 10:
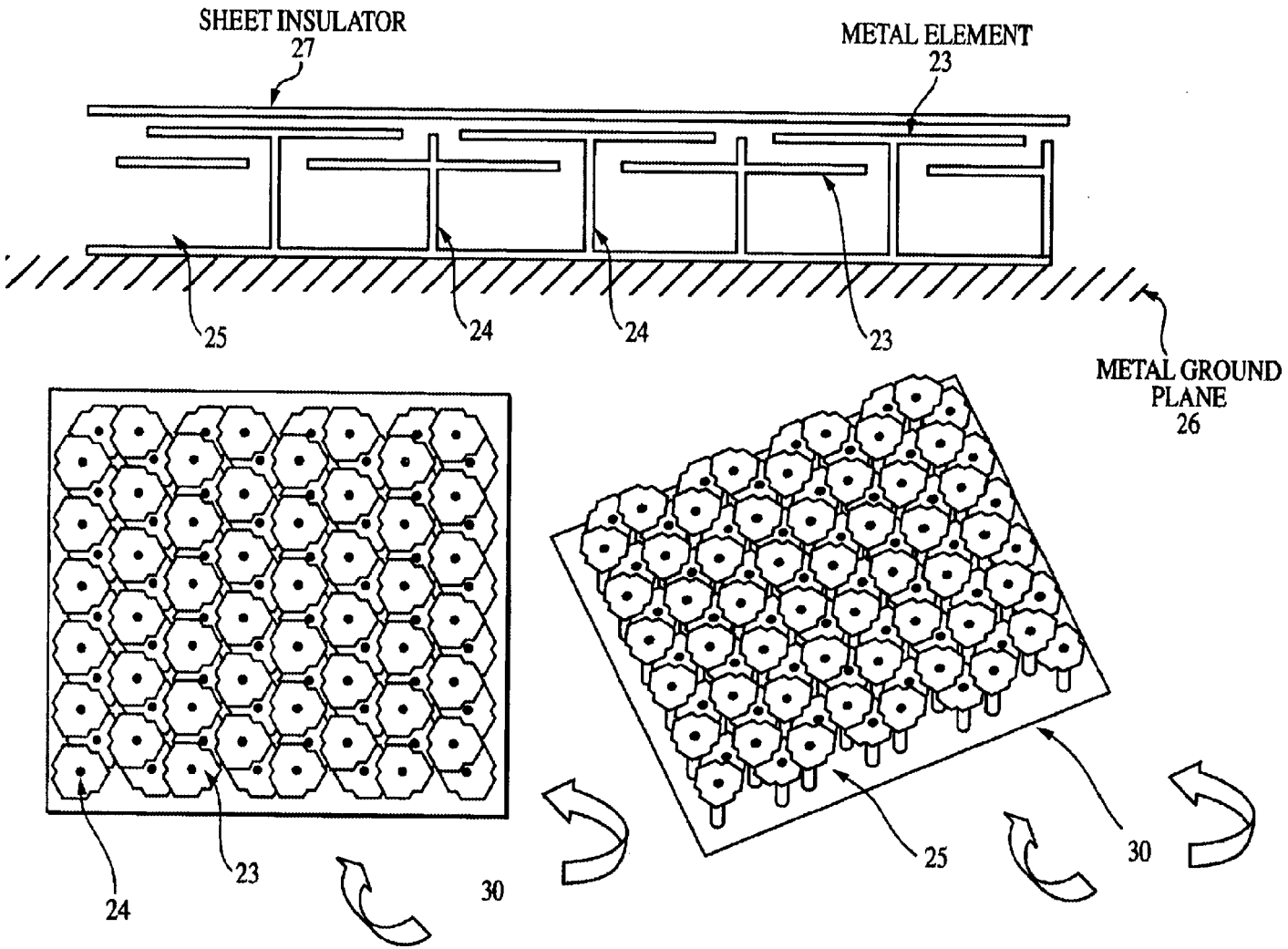
FIG. 10 is a two-dimensional, three-layer MPC high-impedance EM structure.

Another specific high-impedance MPC structure 30 is shown in FIG. 10. It is the two-dimensional, three-layer version. The three-layer version has overlapping metal elements 23 so that the capacitance is increased between adjacent elements, and the corresponding operating frequency is lower. They act like tiny parallel resonant circuits, which block surface current propagation, and also reflect EM waves with zero phase shift. This MPC structure is also designed to have a 50 ohm impedance.

Figure 11:
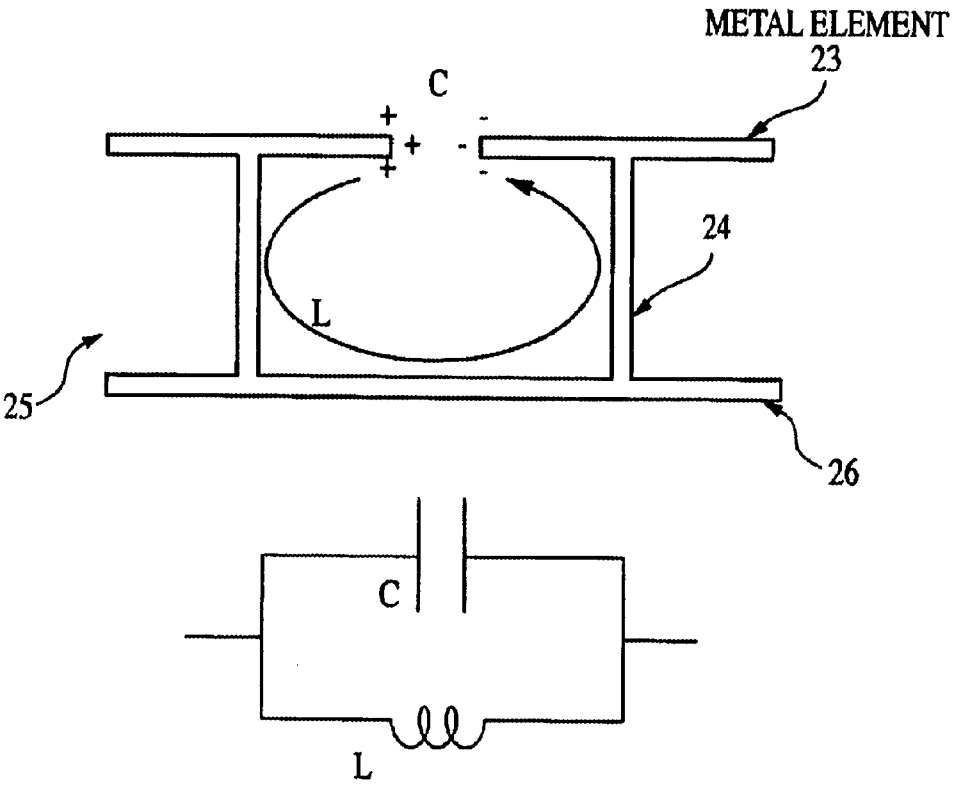
FIG. 11 is the equivalent circuit for the two-dimensional two-layer MPC high-impedance EM structure.

FIG. 11 is the equivalent circuit for the two-dimensional, two-layer high-impedance MPC structure. The impedance of this MPC structure is:

$$Z=j\omega L/(1-\omega^2 LC)$$

Where Z is the impedance, L is the inductance, C is the capacitance, and $\omega$ is $2\pi$ times the frequency. The high-impedance MPC structure should be designed to have an impedance equal to 50 ohms. The bandwidth of the band gap is:

$$\Delta\omega/\omega=(L/C)^{1/2}/(\mu_0/\in_0)^{1/2}$$

where $(\mu_0/\in_0)^{1/2}$ is the free space impedance equal to 377 ohms. The natural frequency can be defined as:

$$\omega_{natural}=\omega^2/\Delta\omega=c/(\mu_r t)$$

where c is the velocity of light, $\mu_r$ is the relative permeability of the PBG material, and t is the thickness of the PBG material. Therefore, equations 1, 2, and 3 are use to determine the impedance, center frequency of the band gap, and bandwidth of the band gap. The frequency and bandwidth of the TWT should be designed to fall within the band gap of the MPC.

Figure 12:
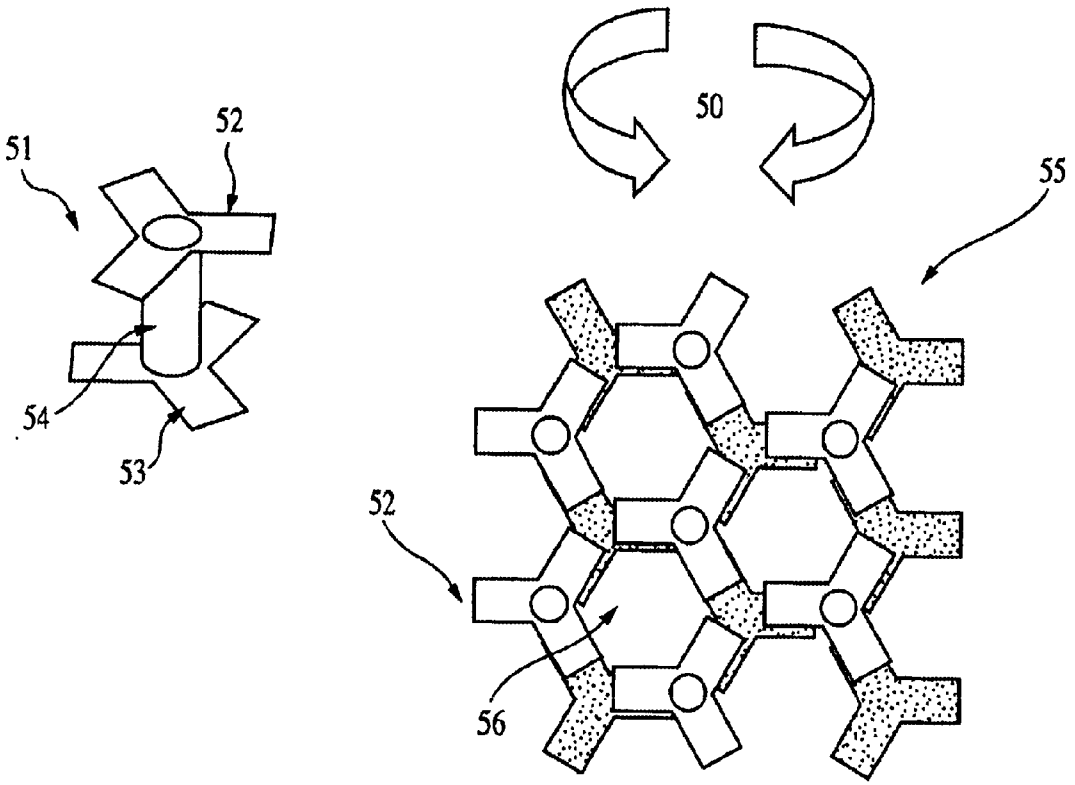
FIG. 12 is a top view of the three-dimensional MPC structure with the <111> layer orientation.

A top view 50 of the three-dimensional MPC is shown in FIG. 12. The three-dimensional MPC is based on the diamond crystal structure with each layer of the crystal forming the <001> or <111> planes of the crystal. FIG. 12 shows the <111> orientation. It is the preferred three-dimensional MPC embodiment because it can be engineered to have both surface and bulk band gaps that overlap, thereby, forbidding surface currents and the propagation of EM radiation through their bulk. Each layer of the MPC has metal elements 51 with three symmetrical wings 52 on the top surface, and three symmetrical wings 53 on the bottom surface, which are rotated 60° with respect to the top surface. Metal center posts 54 joint the top and bottom surfaces of the metal elements 51. A thin insulator sheet, not shown in FIG. 12, is used to separate and insulate each layer, and to form capacitors. The second layer of metal elements 55 are identical to metal elements 51, but they are off-set as shown in FIG. 12. A host ceramic material 56 occupies the volume between metal elements 51 and 55.

Figure 13:
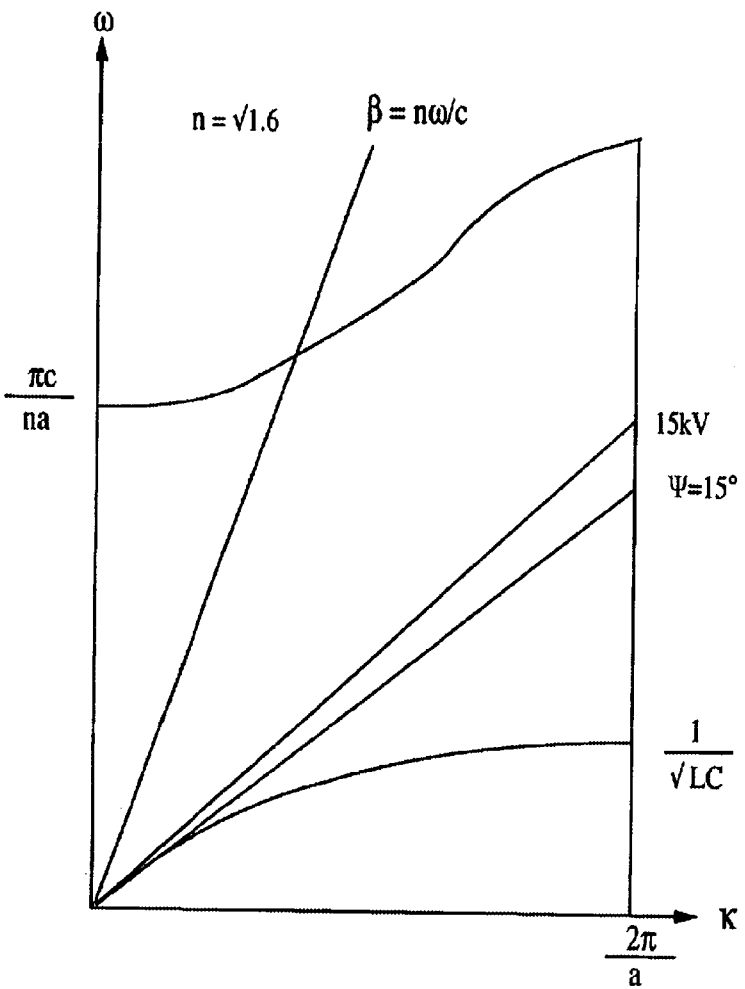
FIG. 13 shows the dispersion curves for a three-dimensional MPC and a developed helical slow-wave circuit on top of a dielectric substrate.

FIG. 13 is a dispersion diagram for the three-dimensional MPC. It shows the upper and lower band edge frequencies given by ($\omega_c \approx \pi c/na$, and $\omega \approx = 1/\sqrt{LC}$ respectively, where c/n is the phase velocity of light in the dielectric substrate and a, is the lattice constant. The 15 kV line and the dispersion curve for a developed sheet helix on a dielectric substrate are also shown in FIG. 13. The equation for the developed sheet helix (on a dielectric substrate) for a slow wave approximation is $\kappa \approx \kappa_0 \cot\psi$, where $\kappa$ is the axial phase constant ($\omega/v_p$), $\kappa_0$ is $\omega n/c$, $v_p$ is the phase velocity, and $\Psi$ is the pitch angle. A pitch angle of 15° was used to illustrate the dispersion curve for the sheet helix. FIG. 13 shows that the dispersion curve for a slow-wave interaction circuit can be designed to fall within the PBG. The relationship between the upper band edge frequency and the frequency of TWT operation is $\omega_c/\omega \approx \lambda_0/2an$, where $\lambda_0$ is the wavelength in free space.

The design and fabrication means for PBG crystals are well known to people skilled in this art, and many references are available on this subject. The company Emerson & Cuming has a wide range of ECCOSTOCK (plastic in rod and sheet format) materials that have low-dielectric constants (3 to 15) with very low loss tangents. Table 1 gives examples of their ECCOSTOCK (plastic in rod and sheet format) dielectric materials. The company Trans Tech also has materials with a wide range of dielectric constants and loss tangents. The design of all the PBG crystals should be made of low-loss and high-voltage breakdown materials. Table 2 gives candidate ferroelectric materials, which are also candidate materials when very high dielectric constants and low loss tangent material is needed. Also note that table 2 gives percent tunability for the ferroelectric materials. This property can be exploited to produce tunable defects and tunable PEG characteristics. The high-impedance MPC structure is well suited for applying a dc bias, which will change the dielectric constant of the ferroelectric material and hence the capacitance, bandwidth or natural frequency of the band gap. This property can be used to change the dispersion characteristics ($\omega$, $\kappa$) of the slow wave interaction circuit in real time. This important function does not presently exist for TWTs.

Figure 14:
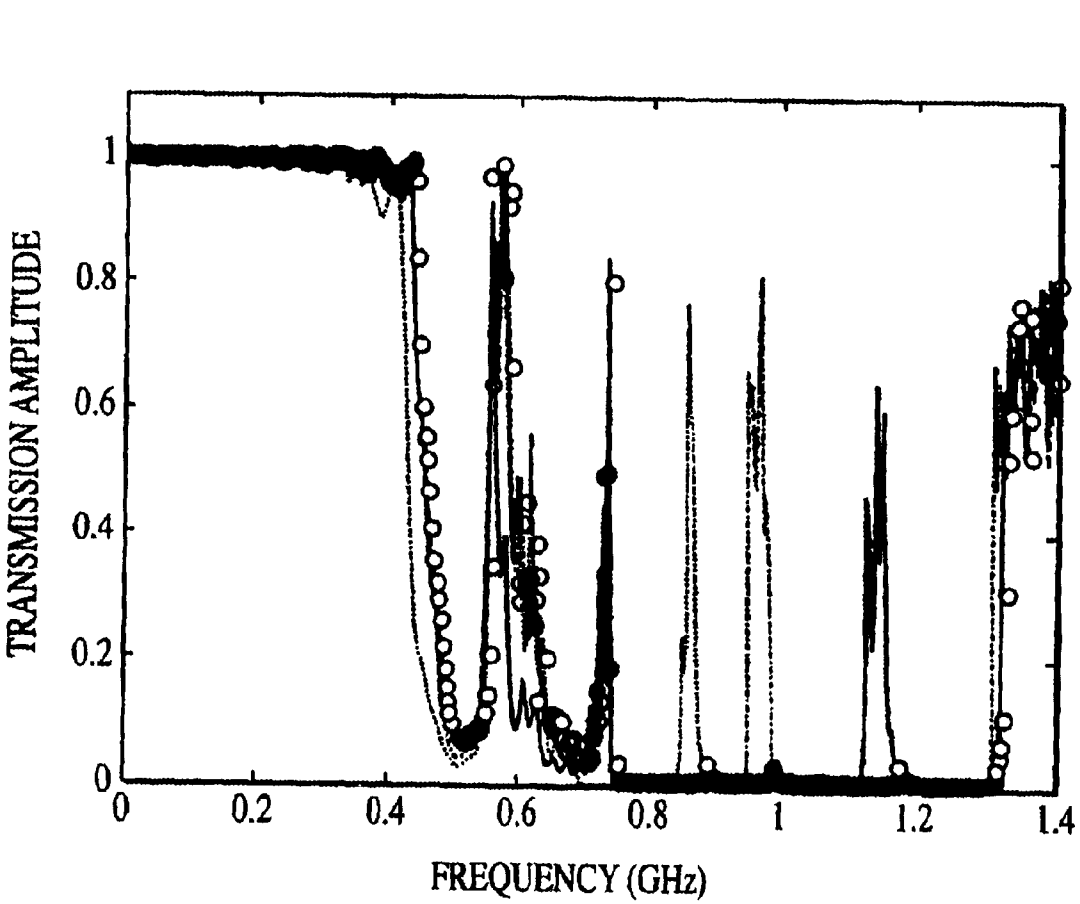
FIG. 14 is a computer plot of a two-dimensional, ferroelectric PBG crystal showing a forbidden band gap from 0.7 to 1.3 GHz and also showing three transmission bands (pass bands) created by changing $\in_r$.

FIG. 14 is a computer plot of a two-dimensional, ferroelectric PBG crystal showing a band gap from 0.7 to 1.3 GHz, and also showing three transmission bands (pass bands) created by changing the dielectric constants of sub-crystals of the PBG crystal. The transmission bands were achieved by increasing the dielectric constant ($\in_r$=22) of the host material to $\in_r$=26 for different lattices of the crystal. As an example, if oscillations were observed to occur at a certain frequency, then one would create a narrow transmission band (EM energy propagates through the PBG crystal) at that frequency to reduce the EM fields in the vicinity of the beam. This will prevent or reduce wave growth at that frequency without adversely effecting wave growth at the desired frequencies. A variable or controllable defect can be produced by using ferroelectric materials (see table 2) and tuning the dielectric constant, $\in_r$ over a wide percentage range by applying different biasing voltages across the ferroelectric material. As an example, one could use the $V_{0+}$ circuit voltage and apply a $V_{0-}$ to the two-dimensional, three-layer MPC structure to give a gradient between the metal elements and slow-wave circuit. Another example, one or more metal elements can be replaced with a circular cross-sectional slab of ferroelectric material. Also, a semiconductor material such as silicon, silicon carbide, gallium arsenide and etc. can also be used for creating defects inside PBG crystals by using optical (laser) source(s) to change the resistance from high (switch off) to low (switch on). The dielectric constant of the semiconductor switch defect will also change during this transition phase. Numerous switches can be employed and turned on and off by utilizing fiber optical cable with predetermined delays to make defects anywhere inside the PBG crystal and at any predetermined time. This technique can also be used to control the dispersion characteristics of the meanderline circuit 2 and equiangular spiral circuit 41, thus controlling oscillations, gain, power output, gain flatness, efficiency, and bandwidth. Other potential defects can be produced using lumped circuit (L, C, $\in_r$, $\mu_r$) materials.

TABLE 1

| ECCOSTOCK HiK: |
|---|
| Dielectric Constants 3 to 15 (tailored values) |
| Dissipation Factor <0.002 (1 to 10 GHz) |
| Volume Resistivity >$10^{12}$ (ohms-cm) |
| Dielectric Strength >200 (volts/mil) |
| Appearance: white |
| Temperature Range: −65 to 110 (degrees C) |
| Fexural Strength: 6500 (psi) |
| Coefficient of Linear Expansion: 36 ($10^{-6}$/° C.) |

HIGHER TEMPERATURE AND DIELECTRIC STRENGTH MATERIALS AVAILABLE IN ECCOSTOCK HiK500F

TABLE 2

FERROELECTRIC CERAMIC MATERIALS (BSTO-OXIDE III)

| Oxide III Content (wt %) | Dielectric Constant | Loss Tangent | % Tunability |
|---|---|---|---|
| 15 | 1147 | 0.0011 | 7.3 |
| 20 | 1079 | 0.0009 | 16.0 |
| 25 | 783 | 0.0007 | 17.5 |
| 30 | 751 | 0.0008 | 9.4 |
| 35 | 532 | 0.0006 | 18.0 |
| 40 | 416 | 0.0009 | 19.8 |
| 60 | 118 | 0.0006 | 9.6 |
| 80 | 17 | 0.0008 | 0.61 |

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

I claim:

1. A printed circuit Traveling-Wave Tube comprising:

a pair of Photonic Band Gap crystal structures;

a pair of meanderline slow-wave interaction circuits respectively printed on said pair of Photonic Band Gap crystal structures;

a gridded electron gun assembly including a heater, cathode, grid and at least one accelerating electrode;

a first set of electrical connections printed on said pair of Photonic Band Gap crystal structures to connect the heater, cathode, grid and at least one accelerating electrode of said electron gun assembly to a power supply;

means for coupling microwave energy onto said meanderline slow-wave interaction circuits including RF input connector means printed on said pair of Photonic Band Gap crystal structures;

means for coupling microwave energy from said meanderline slow-wave interaction circuits including RF output connector means printed on said pair of Photonic Band Gap crystal structures;

a ground plane surrounding each of said RF input connector means and RF output connector means for enhancing microwave energy coupling;

a depressed collector printed on said pair of Photonic Band Gap crystal structures;

a second set of electrical connections printed on said pair of Photonic Band Gap crystal structures connected to said depressed collector;

a zig-zag metal spacer disposed between each of said pair of Photonic Band Gap crystal structures for maintaining a predetermined separation therebetween;

printed conducting metal strips on each side of said meanderline slow-wave interaction circuits for electrostatic focusing and to reduce beam edge effects of a sheet electron beam; and vacuum housing means for enclosing said pair of Photonic Band Gap crystal structures and said pair of meanderline slow-wave interaction circuits.

2. The printed circuit Traveling-Wave Tube of claim 1 wherein said pair of Photonic Band Gap crystal structures includes a pair of two dimensional, two-layer 50-ohm structures including a plurality of spaced apart sheet metal elements disposed in a uniplanar array, with each sheet metal element having a metal center post depending therefrom which is disposed in a host ceramic base and in contact with a ground plane, and a thin sheet insulator overlaying said sheet metal elements for receiving said pair of printed meanderline slow-wave interaction circuits overlaying thereon.

3. The printed circuit Traveling-Wave Tube of claim 1 wherein said Photonic Band Gap crystal structures each comprise a two dimensional, three-layer 50-ohm structure including a first plurality of spaced apart sheet metal elements disposed in a first uniplanar array, with each metal sheet element having a metal center post depending therefrom which is disposed in a host ceramic base and in contact with a ground plane, a second plurality of spaced apart sheet metal elements disposed in a second uniplanar array spaced from and parallel to said first uniplanar array, with each of said first and second metal sheet elements having a metal center post depending therefrom which is disposed in a host ceramic base and in contact with a ground plane, and a thin sheet insulator overlaying said metal sheet elements for receiving said printed overlaying meanderline slow-wave interaction circuits thereon.

4. The printed circuit Traveling-Wave Tube of claim 1 wherein said pair of Photonic Band Gap crystal structures each comprise a three dimensional structure including a first plurality of spaced apart sheet metal elements, each having a three-wing configuration and being similarly oriented in a first uniplanar array, a second plurality of spaced apart sheet metal elements, each having a three-wing configuration and being similarly oriented in a second uniplanar array spaced from and parallel to said first uniplanar array, a plurality of metal center posts, each disposed in a host ceramic base and joined at one end to one of said first sheet metal elements and joined at another end to one of said second sheet metal elements, and a thin sheet insulator overlaying said first sheet metal elements for receiving said pair of printed meanderline slow-wave interaction circuits overlaying thereon.

5. The printed circuit Traveling-Wave Tube of claim 1 wherein said pair of Photonic Band Gap crystal strictures contain donor and acceptor defects that are utilized to change the dispersion characteristics of said pair of slow-wave interaction circuits.

6. The printed circuit Traveling-Wave Tube of claim 1 wherein each of said Photonic Band Gap crystal structures are structurally identical.

7. The printed circuit Traveling-Wave Tube of claim 6 wherein each of said meanderline slow-wave interaction circuits are structurally identical.

8. A printed circuit Traveling-Wave Tube comprising:

a pair of identical multi-arm slow-wave interaction circuits respectively printed on two identical Photonic Band Gap crystal structures;

a gridded electron gun assembly including a heater, cathode, grid and at least one accelerating electrode;

a first set of electrical connections printed on said two identical Photonic Band Gap crystal structures to connect the heater, cathode, grid and accelerating electrodes of said electron gun assembly to a power supply;

at least two RF input connectors printed on said two identical Photonic Band Gap crystal structures;

at least two RF output connectors printed on said two identical Photonic Band Gap crystal structures;

a ground plane surrounding each of said RF input connectors and RF output connectors;

a depressed collector printed on said two identical Photonic Band Gap crystal structures;

a second set of electrical connections printed on said two identical Photonic Band Gap crystal structures connected to said depressed collector;

zig-zag metal spacers between said two identical Photonic Band Gap crystal structures; and a housing for containing at least said pair of identical multi-arm slow-wave interaction circuits respectively printed on two identical Photonic Band Gap crystal structures.

9. The printed circuit Traveling-Wave Tube of claim 8 wherein said Photonic Band Gap crystal structures each comprise a three dimensional structure including a first plurality of spaced apart sheet metal elements, each having a three-wing configuration and being similarly oriented in a first uniplanar array, a second plurality of spaced apart sheet metal elements, each having a three-wing configuration and being similarly oriented in a second uniplanar array spaced from and parallel to said first uniplanar array, a plurality of metal center posts, each disposed in a host ceramic base and joined at one end to one of said first plurality of sheet metal elements and joined at another end to one of said second plurality of sheet metal elements, and a thin sheet insulator overlaying said first plurality of sheet metal elements for receiving said pair of printed meanderline slow-wave interaction circuits overlaying thereon.

10. The printed circuit Traveling-wave Tube of claim 8 wherein said Photonic Band Gap crystal structures contain donor and acceptor defects that are utilized to change the dispersion characteristics of said pair of slow-wave interaction circuits.

11. The printed circuit Traveling-Wave Tube of claim 8 wherein said Photonic Band Gap crystal structures each comprise a two dimensional, two-layer 50-ohm structure including a plurality of spaced apart sheet metal elements disposed in a uniplanar array, with each metal sheet element having a metal center post depending therefrom which is disposed in a host ceramic base and in contact with a ground plane, and a thin sheet insulator overlaying said metal sheet elements for receiving said printed overlaying meanderline slow-wave interaction circuits thereon.

12. The printed circuit Traveling-Wave Tube of claim 8 wherein said Photonic Band Gap crystal structures each comprise a two dimensional, three-layer 50-ohm structure including a first plurality of spaced apart sheet metal elements disposed in a first uniplanar array, with each metal sheet element having a metal center post depending therefrom which is disposed in a host ceramic base and in contact with a ground plane, a second plurality of spaced apart sheet metal elements disposed in a second uniplanar array spaced from and parallel to said first uniplanar array, with each of said first plurality and second plurality of sheet metal elements having a metal center post depending therefrom which is disposed in a host ceramic base and in contact with a ground plane, and a thin sheet insulator overlaying said sheet metal elements for receiving said pair of printed meanderline slow-wave interaction circuits overlaying thereon.

13. A printed circuit Traveling-Wave Tube comprising:

housing means for establishing a vacuum chamber;

means within said housing means for emitting an electron beam;

means within said housing means for collecting an electron beam;

a slow-wave interaction circuit within said housing means in proximity to said electron beam;

an input connector for coupling microwave energy onto said slow-wave interaction circuit;

an output connector for coupling microwave energy from said slow-wave interaction circuit;

a photonic band gap structure within said housing means and having said slow-wave interaction circuit printed thereon;

said photonic band gap structure comprising a two dimensional, two-layer structure including a plurality of spaced apart sheet metal elements disposed in a uniplaner array, with each sheet metal element having a metal center post depending therefrom which is disposed in a host ceramic base and in contact with a ground plane, and a thin sheet insulator overlaying said sheet metal elements for receiving said printed slow-wave interaction Circuit overlaying thereon; and said photonic band gap structure having an operable frequency bandgap wherein electromagnetic energy is substantially prevented from passing therethrough whereby a substantial portion of the electromagnetic energy remains in the vicinity of the electron beam to achieve enhanced performance.

14. The printed circuit Traveling-Wave Tube of claim 13 wherein said photonic band gap structure contains donor and acceptor defects that are utilized to change the dispersion characteristics of said slow-wave interaction circuit.

15. The printed circuit Traveling-Wave Tube of claim 13 further comprising:

another slow-wave interraction circuit within said housing means in proximity to said electron beam;

another input connector for coupling microwave energy onto said another slow-wave interaction circuit;

another output connector for coupling microwave energy from said another slow-wave interaction circuit;

another photonic band gap structure within said housing means and having said another slow-wave interaction circuit printed thereon; and said another photonic band gap structure having an operable frequency bandwidth wherein electromagnetic energy is substantially prevented from passing therethrough whereby a substantial portion of the electromagnetic energy remains in the vicinity of the electron beam to achieve enhanced performance.

16. The printed circuit Traveling-Wave Tube of claim 15 wherein:

said slow-wave interaction circuit and said another slow-wave interaction circuit are both meanderline slow-wave interaction circuits.

17. The printed circuit Traveling-Wave Tube of claim 16 wherein:

each of said photonic band gap structures comprise a two dimensional, three-layer structure including a first plurality of spaced apart sheet metal elements disposed in a first uniplanar array, with each metal sheet element having a metal center post depending therefrom which is disposed in a host ceramic base and in contact with a ground plane, a second plurality of spaced apart sheet metal elements disposed in a second uniplanar array spaced from and parallel to said first uniplanar array, with each of said first and second sheet metal elements having a metal center post depending therefrom which is disposed in a host ceramic base and in contact with a ground plane, and a thin sheet insulator overlaying said sheet metal elements for receiving both of said printed meanderline slow-wave interaction circuits overlaying thereon.

18. The printed circuit Traveling-Wave Tube of claim 16 wherein:

said another photonic band gap structure comprises a two dimensional, two-layer structure including a plurality of spaced apart sheet metal elements disposed in a uniplaner array, with each sheet metal element having a metal center post depending therefrom which is disposed in a host ceramic base and in contact with a ground plane, and a thin sheet insulator overlaying said sheet metal elements for receiving both of said printed slow-wave interaction circuits overlaying thereon.

19. The printed circuit Traveling-Wave Tube of claim 15 wherein:

said slow-wave interaction circuit and said another slow-wave interaction circuit are both equiangular slow-wave interaction circuits.

20. The printed circuit Traveling-Wave Tube of claim 15 further comprising:

a ground plane surrounding each of said input connector and output connector for enhancing microwave energy coupling; and a zig-zag metal spacer disposed between each of said photonic band gap structures for maintaining a predetermined separation therebetween.

* * * * *